US006131972A

United States Patent [19]

Whitehead et al.

[11] Patent Number: 6,131,972

[45] Date of Patent: Oct. 17, 2000

[54] GRIP HANDLE FOR SHOVEL TYPE IMPLEMENT

[75] Inventors: Stephen P. Whitehead, Elgin; Michael R. Vogler; Torrence C. Anderson, both of Aurora, all of Ill.

[73] Assignee: Suncast Corporation, Batavia, Ill.

[21] Appl. No.: 09/141,683

[22] Filed: Aug. 28, 1998

[51] Int. Cl.[7] ..... B25G 1/01

[52] U.S. Cl. ..... 294/57; 294/171; 16/430; 16/DIG. 19

[58] Field of Search ..... 294/57, 59, 171, 294/58; 16/430, 431, 421, DIG. 18, DIG. 19, DIG. 12

[56] References Cited

U.S. PATENT DOCUMENTS

| | | | |
|---|---|---|---|
| D. 189,486 | 12/1960 | Walsh et al. | 294/57 |
| D. 269,490 | 6/1983 | Germain . | |
| D. 291,863 | 9/1987 | Kolonia . | |
| D. 296,410 | 6/1988 | Abbott | D8/10 |
| D. 331,652 | 12/1992 | Wu . | |
| D. 384,559 | 10/1997 | Tisbo et al. . | |
| D. 384,866 | 10/1997 | Tisbo et al. . | |
| D. 385,160 | 10/1997 | Tisbo et al. . | |
| D. 398,202 | 9/1998 | Tisbo et al. | D8/10 |
| 2,579,484 | 12/1951 | Fenton | 294/57 |
| 3,697,110 | 10/1972 | Portz et al. | 294/57 |
| 4,031,775 | 6/1977 | Petty | 16/430 |
| 4,155,582 | 5/1979 | Reisner | 294/58 |
| 4,280,727 | 7/1981 | Germain . | |
| 4,841,596 | 6/1989 | Fink | 16/DIG. 12 |
| 5,503,442 | 4/1996 | Lee | 294/1.4 |
| 5,520,430 | 5/1996 | Clark, Jr. | 294/57 |
| 5,813,206 | 9/1998 | McKittrick | 294/58 |

FOREIGN PATENT DOCUMENTS

| | | | |
|---|---|---|---|
| 896742 | 5/1962 | United Kingdom | 294/58 |

*Primary Examiner*—Robert P. Olszewski
*Assistant Examiner*—Paul T. Chin
*Attorney, Agent, or Firm*—Welsh & Katz, Ltd.

[57] ABSTRACT

A D-shaped grip handle for use with a hand manipulated implement includes a generally U-shaped portion having an integral mounting sleeve for mounting the grip handle on the end of a shaft and having a hand grip bar integrally formed with the U-shaped portion so as to be disposed substantially transverse to the longitudinal axis of the mounting sleeve. The grip bar has a layer of soft rubber material, such as thermoplastic rubber, formed circumferentially thereon so as to create a pattern of spaced raised pads along approximately one-half of the circumference of the soft rubber layer, with the remaining half of said circumference defining a continuous smooth grip surface having an undulating contour to receive the fingers of the user's hand. The raised pads on the soft grip layer provide improved traction with the palm of the user's hand while the smooth opposite surface of the soft grip layer spreads the lifting force evenly onto the palm of the user's hand to thereby increase the comfort during use and reduce the effort required to manipulate an implement with which the grip handle is used.

14 Claims, 2 Drawing Sheets

GRIP HANDLE FOR SHOVEL TYPE IMPLEMENT

BACKGROUND OF THE INVENTION

The present invention relates generally to grip handles for hand manipulated implements such as shovels and the like, and more particularly to a novel grip handle providing improved traction and comfort with a user's hand.

It is conventional in the manufacture of shovel-like implements, such as snow shovels, ground working shovels and pronged ground working type implements, to secure one end of an elongated shaft to a blade or pronged portion of the implement, and affix a grip handle to the opposite free end of the shaft to facilitate manipulation of the implement. Typically, the grip handle has a generally D-shape with the curved or U-shaped portion being secured to the implement shaft so that a hand grip bar portion is disposed generally transverse to the axis of the shaft. The hand grip bar portion may be made integral with the remainder of the grip handle or may be a separate piece, such as a wood, metal or plastic generally cylindrical grip bar, to facilitate grasping by the user's hand.

Attempts have been made to improve the friction and traction relation between a user's hand and the grip handles of implements of the aforedescribed type. For example, it is known to provide a molded grip handle wherein the hand grip bar has a generally cylindrical hollow configuration with openings spaced longitudinally along the grip bar to enhance gripping when the user's figures encircle the grip bar, as disclosed in U.S. Pat. No. 4,280,727. Another technique for enhancing gripping of the grip handle is to form the hand grip bar so that rib-like elements are formed in parallel longitudinally spaced relation along the grip bar, as disclosed in U.S. Pat. No. Des. 291,863. Still another technique for enhancing gripping of an implement grip handle is to provide grooves in the grip bar that extend fully circumferentially about the generally cylindrical grip bar, as disclosed in U.S. Pat. Nos. Des. 384,559 and Des. 385,160, both of which are assigned to the assignee of the present invention.

In order to improve comfort to the user when manipulating an implement having a generally D-shaped grip handle, it is known to apply a soft material onto the grip bar so as to form a cushion-like exterior layer about the grip bar. While hand grip bars having cushion-like layers provide greater comfort for the user's hand then do grip bars without such layers, the known cushion layer grip bars do not provide both increased comfort and increased traction between the grip and the user's hand so as to require less effort in manipulating the implement. The present invention provides improved traction with the user's hand while also enhancing the comfort and cushioning relation with the user's hand.

SUMMARY OF THE INVENTION

A general object of the present invention is to provide a novel generally D-shaped grip handle for a shovel implement and the like that provides improved traction and comfort with a user's hand.

A more particular object of the present invention is to provide a novel grip handle for a shovel implement and the like wherein a soft relatively high friction layer is overlaid onto a hand grip portion of the grip handle in a configuration to enhance traction and comfort with a user's hand and reduce the effort required to manipulate the implement.

Another object of the present invention is to provide a novel generally D-shaped grip handle for a shovel implement and the like as described wherein a generally D-shaped handle is first provided having a grip bar in which a plurality of recesses are formed on diametrically opposite sides of the grip bar, and a soft rubber material is overlaid onto the grip bar so as to embed in the recesses and establish a pattern of raised pads that provide a comfortable soft relatively high-traction hand grip for the user's hand.

A feature of the grip handle in accordance with the present invention lies in forming the pattern of raised pads along an outwardly facing surface portion of the hand grip bar, and forming the opposite facing surface portion of the hand grip bar as a ribless continuous smooth surface having undulations to receive the user's fingers so that the gripping force is evenly distributed onto the palm of the user's hand.

In carrying out the present invention, a D-shaped grip handle (termed a D-grip) is formed, as by molding from a relatively high strength plastic material, such that a generally U-shaped portion has an integral mounting sleeve for mounting the grip handle on the end of a shaft that may have its opposite end affixed to an implement, such as the blade of a shovel. The D-grip has a hand grip bar integrally formed with the U-shaped portion so as to be disposed substantially transverse to the longitudinal axis of the mounting sleeve. The grip bar has a plurality of recesses lying in parallel planes transverse to the grip bar and spaced along the bar on opposite sides thereof. A layer of soft rubber material, such as thermoplastic rubber, is then formed circumferentially on the grip bar so as to create a pattern of spaced raised pads along the top of the grip bar (considered with the grip handle oriented with the mounting sleeve directed downwardly with its longitudinal axis substantially vertical). The raised pads are formed to cover approximately the upper half of the circumference of the soft rubber layer, with the lower half defining a continuous smooth grip surface having an undulating contour to receive the fingers of the user's hand. The raised pads on the soft grip layer provide improved traction with the palm of the user's hand while the smooth opposite surface of the soft grip layer spreads the lifting force evenly onto the palm of the user's hand to thereby increase the comfort during use and reduce the effort required to manipulate an implement with which the grip handle is used.

Further objects, features and advantages of the present invention will become apparent from the following detailed description of a preferred embodiment of the invention, taken with the accompanying drawing wherein like reference numerals refer to like elements throughout the several views.

DETAILED DESCRIPTION

Figure 1:
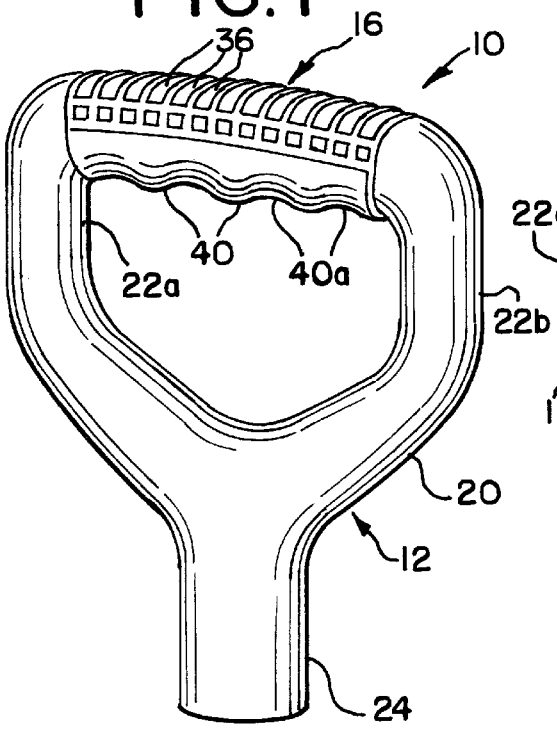
FIG. 1 is a perspective view of a grip handle for a shovel type implement constructed in accordance with a preferred embodiment of the present invention.

Referring now to the drawing, and in particular to FIG. 1, a grip handle that finds particular application with a shovel-like implement is indicated generally at 10. The grip handle 10 may, for example, be used with a hand manipulated implement such as a show shovel, ground working shovel or pronged type ground working implement to facilitate manual manipulation of the implement. The grip handle is adapted to be secured to an end of an elongated shaft (not shown) having its opposite end affixed to a blade or pronged portion of the implement so that the user may grip the grip handle with one hand and place his/her other hand on the shaft to facilitate manipulation of the implement, as is known. The grip handle 10 includes a D-shaped grip handle, indicated generally at 12, which may alternatively be termed a D-grip, having a grip bar portion 14 (FIG. 2) on which is formed a layer 16 of soft rubber material, such as thermoplastic rubber, so as to provide a comfortable high traction circumferential gripping surface on the grip handle.

Figure 2:
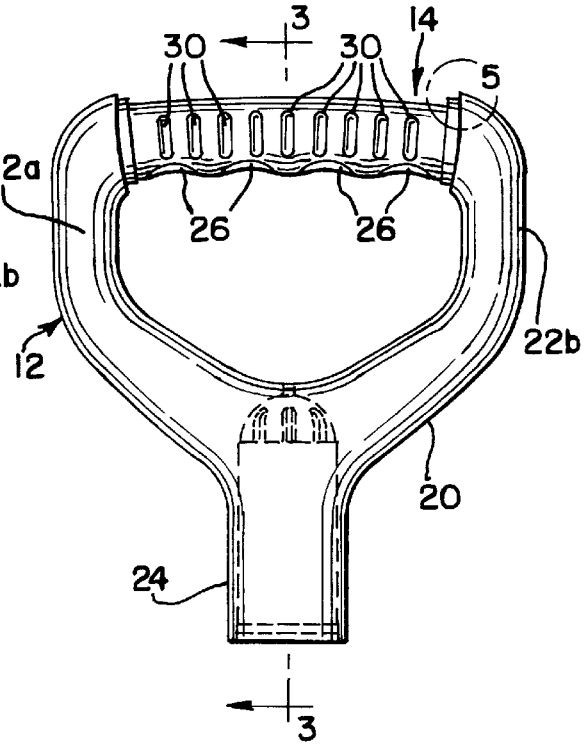
FIG. 2 is a front elevational view of a D-shaped handle as used in the embodiment of FIG. 1 but showing the grip bar prior to having the soft high traction grip surface applied thereto.
Figure 3:
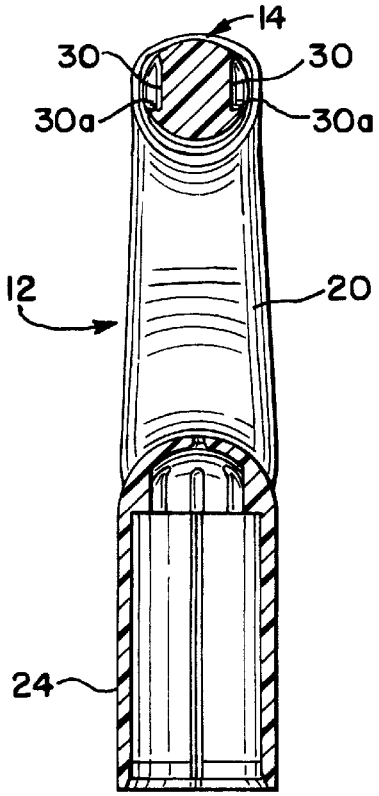
FIG. 3 is a sectional view taken substantially along the line 3—3 of FIG. 2.

Referring particularly to FIGS. 2–5, the D-shaped grip handle portion 12 is preferably formed by molding it from a relatively high strength plastic material, such as polypropylene, with a generally U-shaped portion 20. The U-shaped portion 20 has a pair of generally parallel arm portions 22*a* and 22*b* terminating at their lower ends in an integrally formed tubular mounting sleeve 24 that facilitates mounting of the grip handle on the end of an implement shaft. The U-shaped portion 20, including the arms 22*a,b* and tubular mounting sleeve 24, preferably have generally circular transverse cross sectional configurations throughout their respective lengths. The upper ends of the arm portions 22*a* and 22*b* are formed integral with opposite ends of the grip bar 14 so that the grip bar is connected to and extends between the arm portions 22*a,b*. The grip bar 14 is preferably formed of a generally cylindrical configuration having either a circular or slightly oblong transverse configuration, as illustrated in FIG. 3, and has a longitudinal axis lying generally transverse to the longitudinal axis of the tubular mounting sleeve 24. In this manner, when the grip handle is mounted on the shaft of an implement, the grip handle will lie generally transverse to the longitudinal axis of the shaft.

With the D-shaped grip handle portion 12 disposed in a generally vertical orientation, as illustrated in FIGS. 2 and 3, preferably at least the upper one-half of the circumference of the grip bar 14 has a generally semi-cylindrical surface having a substantially uniform radius of curvature along its longitudinal length. The lower generally one-half of the circumference of the grip bar is formed with an undulating contour so as to form at least four finger receiving undulations or depressions 26 along the length of the grip bar.

Figure 4:
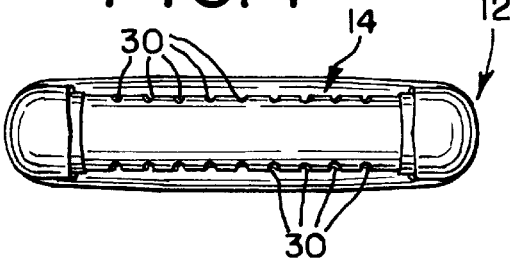
FIG. 4 is a top plan view of the D-shaped handle of FIG. 2.

During forming of the grip bar 14, as by a suitable molding process, a plurality of indentations or recesses are formed along diametrically opposite sides of the grip bar. Referring to FIGS. 2–4, the depressions or recesses 30 are formed in diametrically opposed pairs with each pair lying in a plane generally transverse to the longitudinal axis of the grip bar, and with the pairs of recesses being generally equally spaced along the length of the grip bar. As shown in FIG. 3, the recesses 30 may be formed in the grip bar so as to form a step 30*a* at the lower end of each of the recesses when the grip handle portion 12 is considered in a generally vertical orientation. As will be described, the recesses 30 cooperate with the soft rubber layer 16 when overlaid on the grip bar 14 to prevent relative rotation between the soft rubber layer and the grip bar.

Figure 5:
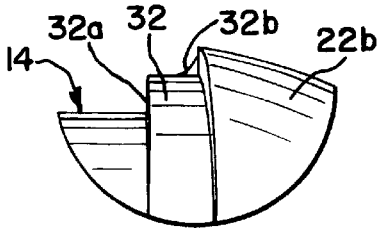
FIG. 5 is an enlarged detail view taken in the area of the circle 5 shown in FIG. 2.
Figure 6:
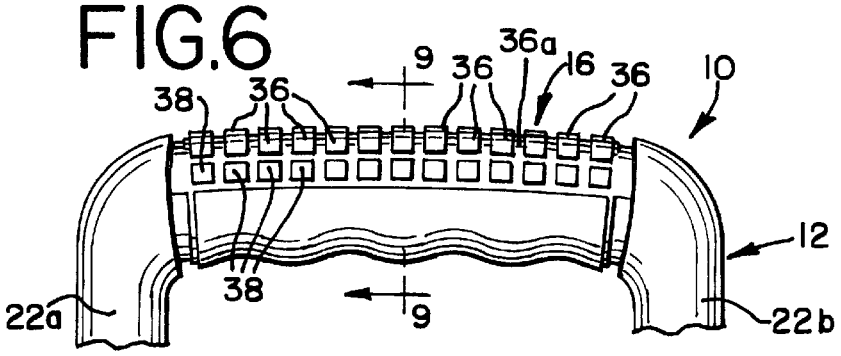
FIG. 6 is a fragmentary elevational view of the handle of FIG. 2 but having a soft high traction grip surface overlaid on the grip bar portion of the handle.
Figure 7:
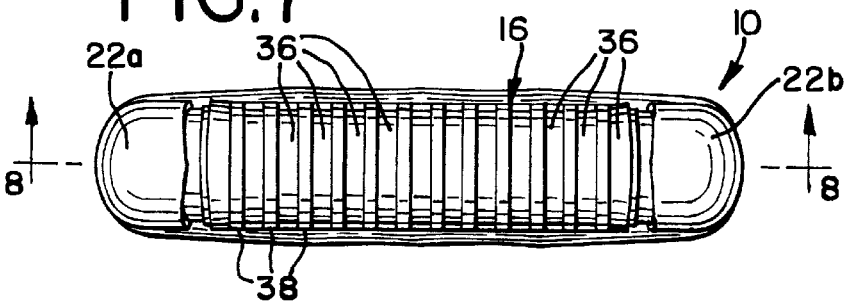
FIG. 7 is a top plan view of the grip handle of FIG. 6.
Figure 8:
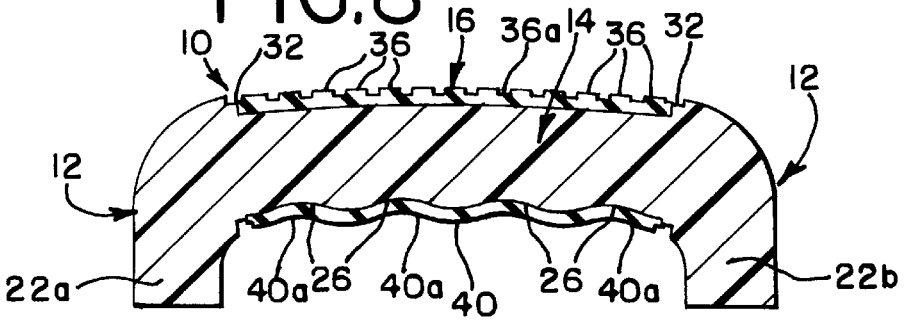
FIG. 8 is a sectional view taken substantially along line 8—8 of FIG. 7.
Figure 9:
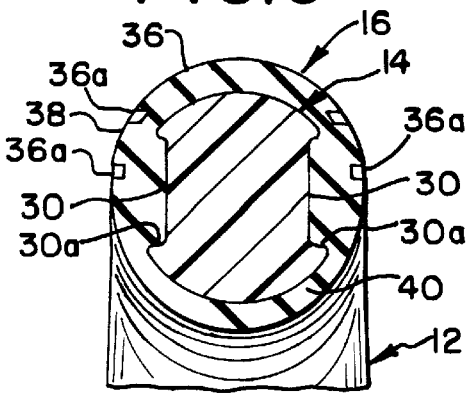
FIG. 9 is a transverse sectional view of the finished grip bar taken along line 9—9 of FIG. 6.

As best illustrated in FIG. 5, each end of the grip bar 14 is connected to a corresponding end of the arms 22*a* and 22*b* of the U-shaped handle portion 20 through an increased diameter boss having an annular surface 32 and establishing an annular stop surface 32*a* peripherally of the grip bar. The annular stop surfaces 32*a* serve as end boundaries for the soft rubber layer 16 when molded about the grip bar 14. Preferably a fillet 32*b* is formed peripherally of each increased diameter surface 32 and the adjacent end of the corresponding arm 22*a* or 22*b* of the U-shaped grip handle portion 20.

After forming the D-shaped grip handle or D-grip 12 as illustrated in FIGS. 2–5, the soft rubber layer 16, such as a thermoplastic rubber, is molded about the grip bar portion 14 so that the layer 16 extends into the recesses 30 in the grip bar and fully circumferentially about the grip bar between the annular stop surfaces 32*a* formed at opposite ends of the grip bar. The rubber layer 16 is formed on the grip bar so as to create a pattern of external raised pads preferably along at least the top one-half of the circumference of the layer 16, as considered with the grip handle in a generally vertical orientation. In the illustrated embodiment, the raised pads comprise a first plurality of generally elongated rectangular pads 36 that are raised in height from a uniformly curved base surface 36a such that the outer surfaces of the pads 36 lie generally on a common diameter relative to the axis of the grip bar and are curved about the uppermost region of the grip bar. The pads 36 are positioned so that the major axes of the rectangular pads 36 lie in planes substantially transverse to the longitudinal axis of the grip bar and are generally equally spaced along the length of the grip bar. The pattern of external raised pads on the layer 16 includes a second plurality of rectangular raised pads 38 having the same radial height relative to the base surface 36a as the elongated rectangular pads 36 so that outer surfaces of the pads 38 are coplanar with the outer surfaces of pads 36. The pads 38 may be generally square in plan configuration and have widths substantially equal to the transverse widths of the pads 36. A pair of raised pads 38 are formed in cooperation with each of the raised pads 36 such that the smaller area pads 38 are spaced from opposite ends of the pads 36 and have longitudinal axes lying in the same transverse planes containing the major longitudinal axes of the corresponding pads 36.

As aforedescribed, the raised pads 36 and 38 are preferably formed to extend outwardly from approximately the upper one-half of the circumference of the soft rubber layer 16. The lower one-half of the circumference of the layer 16 is formed as a uniform thickness of thermoplastic rubber extending along the full length of the grip bar 14 between the stop end surfaces 32*a* so as to create an undulating surface area 40 having finger receiving recesses or undulations 40*a* corresponding to the undulating recesses 26 formed in the grip bar 14. In this manner, the lower half of the grip layer 16 defines a continuous smooth grip surface having an undulating contour to receive the fingers of the user's hand. The outermost surface areas of the pads 36 and 38 are preferably provided with a texture to increase the friction or traction with the user's hand while the lower or opposite contoured surface 40 of the grip layer 16 receives the user's fingers to provide additional traction with the user's hand as well as to spread the lifting force evenly onto the palm of the user's hand to thereby increase hand comfort and reduce the effort required to manipulate an implement with which the grip handle 10 is used.

While a preferred embodiment of the present invention has been illustrated and described, it will be understood to those skilled in art that changes and modifications may be made therein without departing from the invention in its broader aspects. For example, the rectangular shaped pads 36 and 38 may have different plan configurations, such as being circular, oval, elliptical or other plan configuration, and selectively spaced along the length of the upper outermost area of the grip bar so as to provide high traction and comfort to the user's hand.

Various features of the invention are defined in the following claims.

What is claimed is:

1. A grip handle for use with an implement of the type having a shaft on which the grip handle may be mounted, said grip handle comprising a generally D-shaped handle including a generally U-shaped portion adapted for mounting the handle on the end of a shaft and having spaced apart arm portions, a hand grip bar secured to and between said arm portions and having a plurality of recesses formed along its length, and a layer of soft material formed circumferentially on an outer peripheral surface of said grip bar so as to be imbedded in said recesses to prevent rotation of said layer about said grip bar, said layer having a pattern of spaced raised pads formed on a portion of an outer exposed surface of said layer so that the palm of a user's hand at least partially engages said raised pads when gripping said grip bar, the remainder of said outer exposed surface of said layer of soft material defining a continuous smooth finger grip surface area adapted to be engaged by the user's fingers when gripping said grip bar.

2. A grip handle defined in claim 1 wherein said D-shaped handle has a tubular sleeve portion adapted to be fixed on an end of a shaft.

3. A grip handle as defined in claim 1 wherein said grip bar is generally cylindrical, said recesses being formed on diametrically opposite sides of said grip bar so as to lie in parallel spaced planes substantially transverse to the longitudinal axis of said grip bar.

4. A grip handle as defined in claim 3 wherein said D-shaped handle is made from polypropylene.

5. A grip handle as defined in claim 1 wherein said soft material comprises a thermoplastic rubber.

6. A grip handle as defined in claim 1 wherein said grip bar is generally cylindrical, said raised pads being formed on approximately one-half the circumference of said layer of soft material.

7. A grip handle as defined in claim 6 wherein approximately one-half the circumference of said grip bar opposite said portion on which said pads are formed defines a continuous relatively smooth grip surface having an undulating contour to receive the fingers of a user's hand.

8. A grip handle as defined in claim 6 wherein said raised pads are generally rectangular in plan view.

9. A grip handle for use with an implement of the type having a shaft on which the grip handle may be mounted, said grip handle comprising a generally D-shaped handle including a generally U-shaped portion adapted for mounting the handle on the end of a shaft and having spaced apart arm portions, a generally cylindrical hand grip bar secured to and between said arm portions, and a layer of soft material formed circumferentially on an outer peripheral surface of said grip bar, said layer having a pattern of spaced raised pads formed on approximately one-half the circumference of an outer exposed surface of said layer so that the palm of a user's hand at least partially engages said raised pads when gripping said grip bar, said raised pads being generally rectangular in plan view and including a plurality of first elongated rectangular pads having major axes lying in parallel spaced planes substantially transverse to the longitudinal axis of said grip bar, and at least one smaller size second rectangular pad disposed adjacent each end of said first rectangular pads, the remainder of said outer exposed surface of said layer of soft material defining a continuous smooth finger grip surface area adapted to be engaged by the user's fingers when gripping said grip bar.

10. A D-shaped grip handle comprising a generally U-shaped portion having an integral mounting sleeve for mounting the grip handle on the end of a shaft that may have its opposite end affixed to an implement, a hand grip bar fixed to said U-shaped portion so as to be disposed substantially transverse to the longitudinal axis of the mounting sleeve, said grip bar has a plurality of recesses lying in parallel planes transverse to the grip bar and spaced along the bar on opposite sides thereof, and a layer of soft rubber material formed circumferentially on the grip bar so as to create a pattern of spaced raised pads along approximately one-half the circumference of the grip bar, a remaining approximately one-half circumference of said grip bar defining a continuous smooth grip surface having an undulating contour to receive the fingers of a user's hand, said raised pads providing improved traction with the palm of the user's hand and said smooth undulating contour surface of the soft grip layer being operative to distribute the lifting force generally evenly onto the palm of the user's hand to thereby increase the comfort and traction between the grip and a user's hand.

11. A grip handle as defined in claim 10 wherein said U-shaped portion and said hand grip bar are formed as a unitary molded high strength plastic member.

12. A grip handle as defined in claim 10 wherein said raised pads are formed along the top one-half of the circumference of said grip bar when considered with said grip handle oriented with said mounting sleeve directed downwardly with its longitudinal axis substantially vertical.

13. A grip handle as defined in claim 10 wherein said raised pads include a plurality of first elongated rectangular pads having major axes lying in parallel spaced planes substantially transverse to the longitudinal axis of said grip bar, and a plurality of smaller size second rectangular pads disposed adjacent opposite ends of said first rectangular pads.

14. A grip handle as defined in claim 12 wherein said U-shaped portion and said grip bar are formed of a rigid plastic material, said layer of soft rubber material comprising a thermoplastic material.

* * * * *